United States Patent [19]

Geissler

[11] 4,004,257

[45] Jan. 18, 1977

[54] TRANSMISSION LINE FILTER

[75] Inventor: Robert G. Geissler, Cranford, N.J.

[73] Assignee: Vitek Electronics, Inc., Middlesex, N.J.

[22] Filed: July 9, 1975

[21] Appl. No.: 594,270

[52] U.S. Cl. ..... 333/73 C; 29/600; 333/82 B; 333/97 S

[51] Int. Cl.[2] ..... H01P 1/14; H01P 7/04; H01P 1/20; H01P 11/00

[58] Field of Search ..... 333/10, 1.1, 1–7, 333/7 D, 70 R, 73 R, 70 S, 73 C, 97 R, 97 S, 82 B; 178/DIG. 13; 29/592, 600; 340/147 R, 147 C, 147 CV, 147 SC

[56] References Cited

UNITED STATES PATENTS

| | | | |
|---|---|---|---|
| 2,925,565 | 2/1960 | Cook et al. | 333/1.1 |
| 3,138,768 | 6/1964 | Evans | 333/97 |
| 3,414,844 | 12/1968 | Putz | 333/73 C |
| 3,416,102 | 12/1968 | Hamlin | 333/96 X |
| 3,503,015 | 3/1970 | Coraccio et al. | 333/7 D |
| 3,566,020 | 2/1971 | Kinross et al. | 178/6 |
| 3,849,743 | 11/1974 | Treczka | 333/10 |
| 3,896,402 | 7/1975 | Jackson | 333/10 X |

FOREIGN PATENTS OR APPLICATIONS

| | | | |
|---|---|---|---|
| 1,146,559 | 4/1963 | Germany | 333/10 |

*Primary Examiner*—Alfred E. Smith
*Assistant Examiner*—Marvin Nussbaum
*Attorney, Agent, or Firm*—Bauer, Amer & King

[57] ABSTRACT

A transmission line filter having two conductors with insulation therebetween. A third conductor of a length related to the wavelength of the signal being filtered is spaced from one of the conductors but electrically coupled thereto. Terminal connectors are located at each end of the filter to interconnect the filter into the regular transmission line of the system in which the filter is being used. The filter can be formed of coaxial cable and can be a single frequency filter a multiple frequency filter of a bandpass filter arrangement. In a filter trap arrangement, one end of the third conductor is conductively connected to the other of the main conductors. A method for making a coaxial embodiment of the filter is achieved by initially placing the main line inner conductor together with the third conductor within the dielectric and subsequently chopping out sections of the third conductor line to adjust its length to the wavelength of the signal being filtered and to provide electrical connection to the outer shield which is subsequently placed over the dielectric. The filter provides unique application in controlling programs sent to subscribers in cable TV systems.

25 Claims, 36 Drawing Figures

FIG. 1
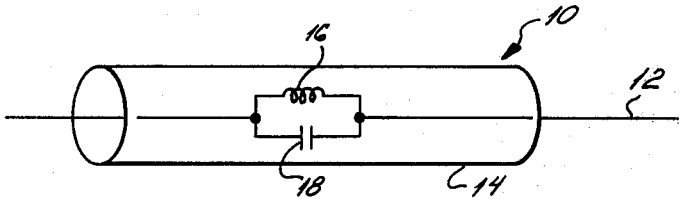
FIG. 2
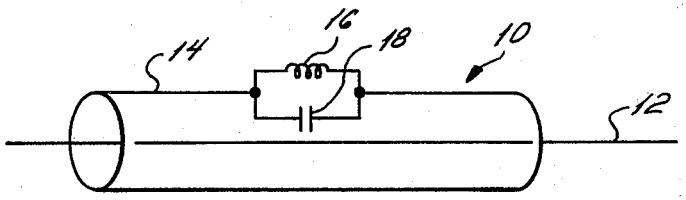
FIG. 3
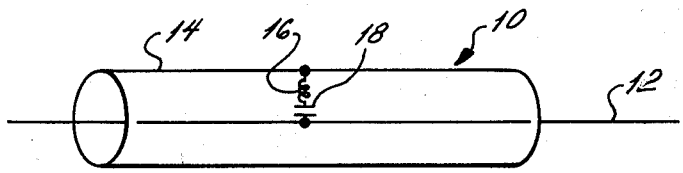
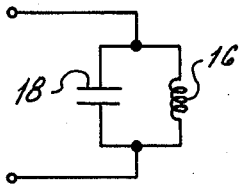
FIG. 4a
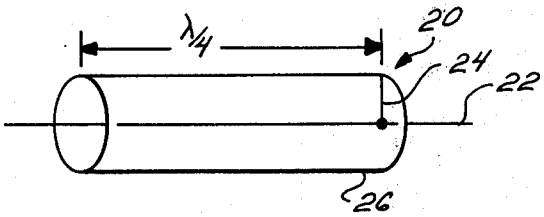
FIG. 4b
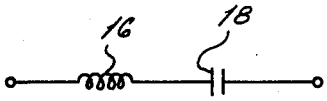
FIG. 5a
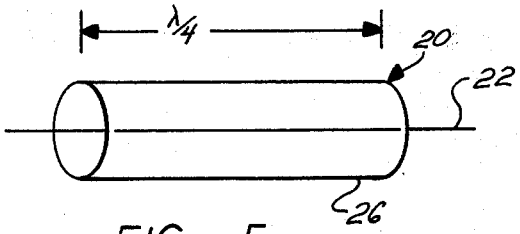
FIG. 5b

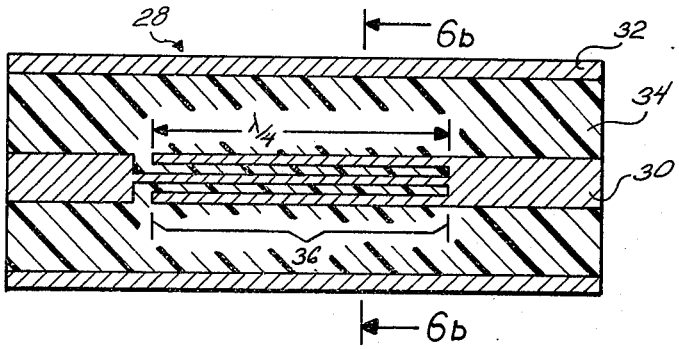
FIG. 6a
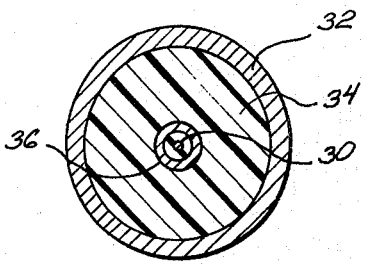
FIG. 6b
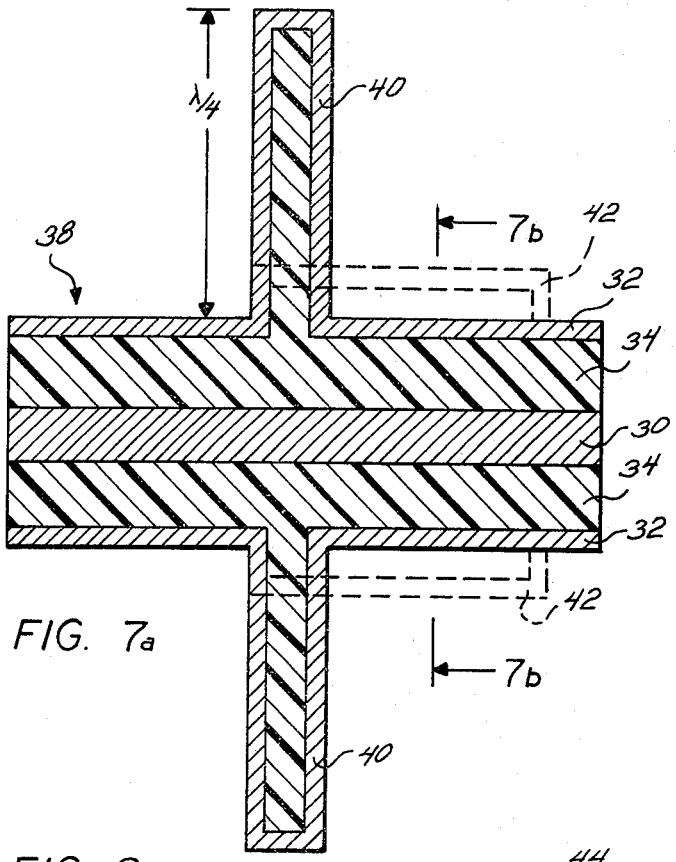
FIG. 7a
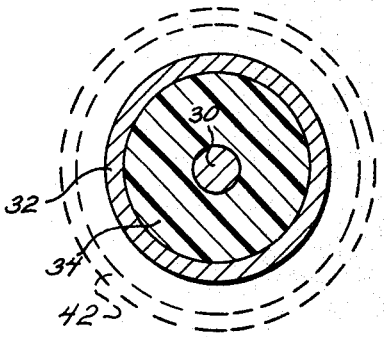
FIG. 7b
FIG. 8a
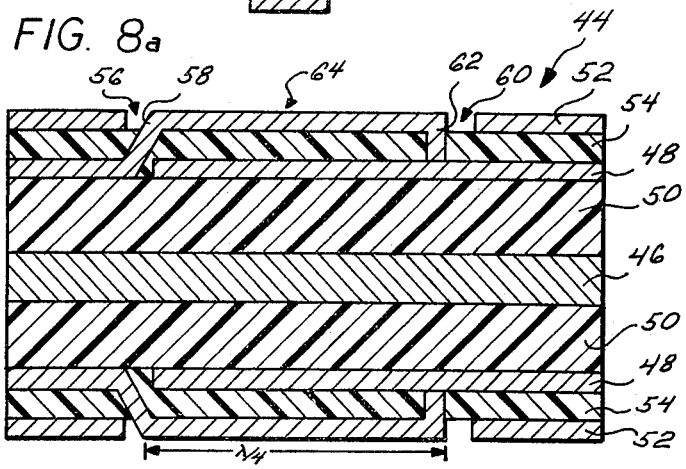
FIG. 8b
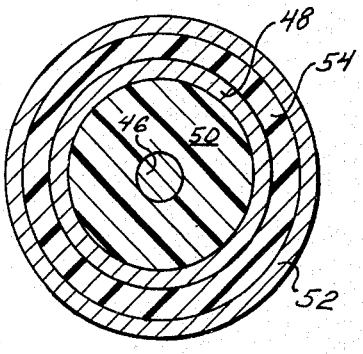

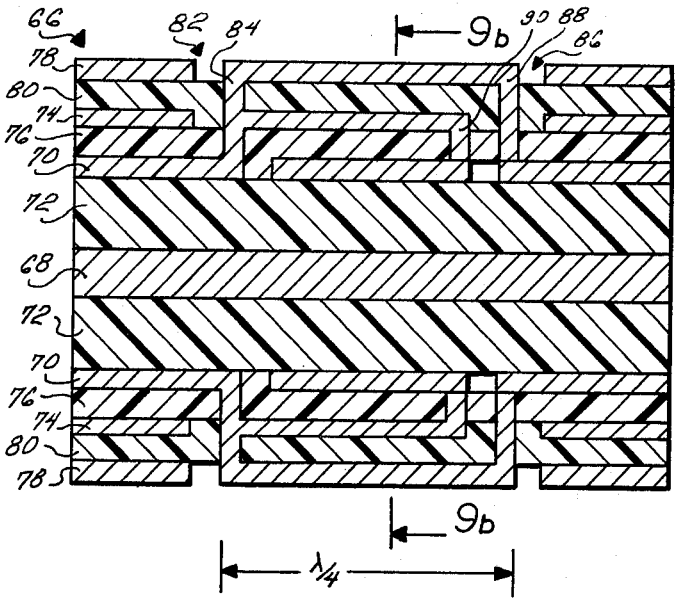
FIG. 9a
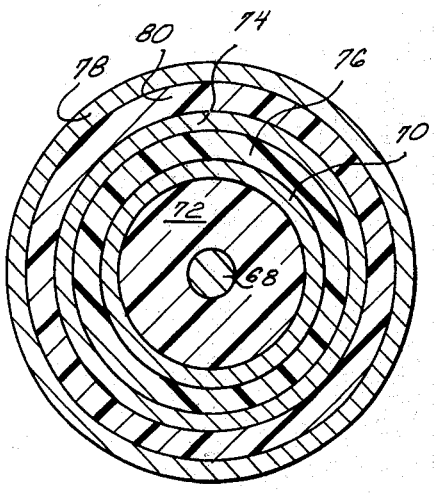
FIG. 9b
FIG. 10
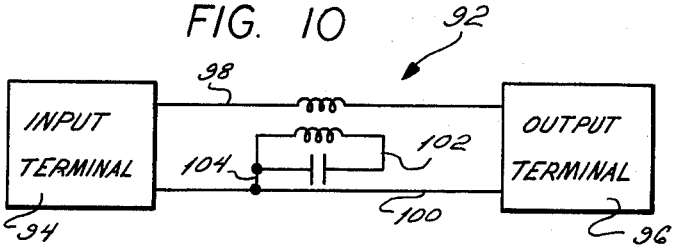

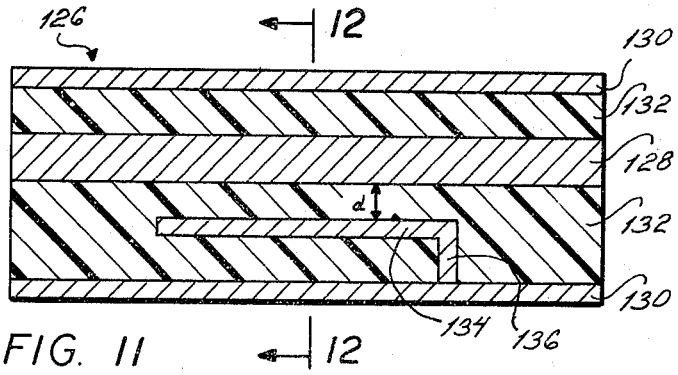
FIG. 11
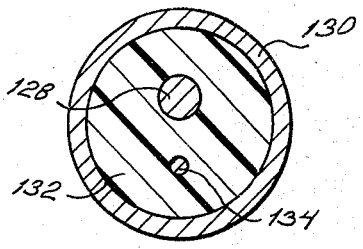
FIG. 12
FIG. 13
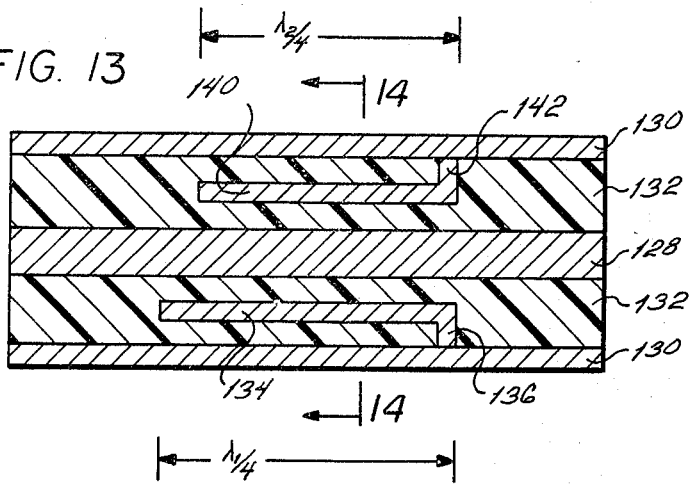
FIG. 14
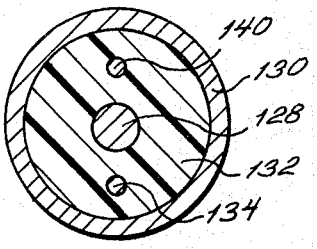
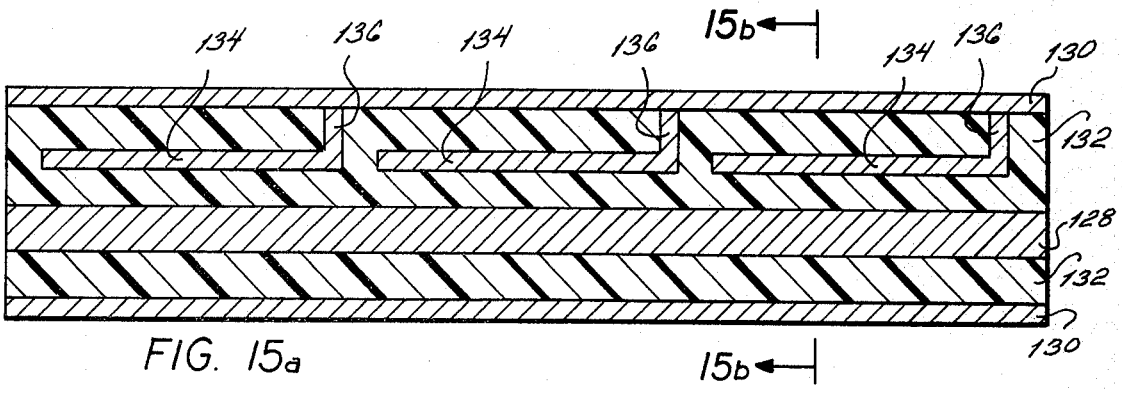
FIG. 15a
FIG. 16
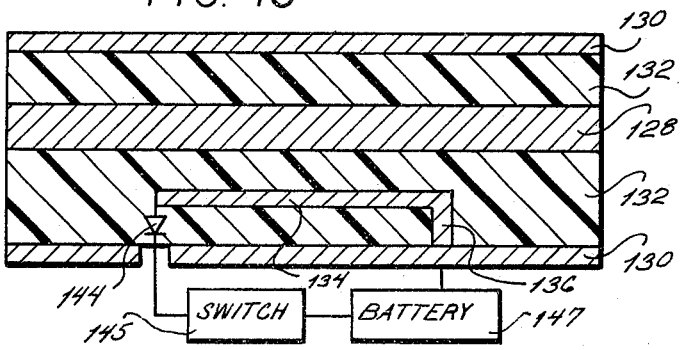
FIG. 15b
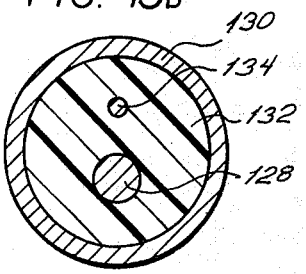

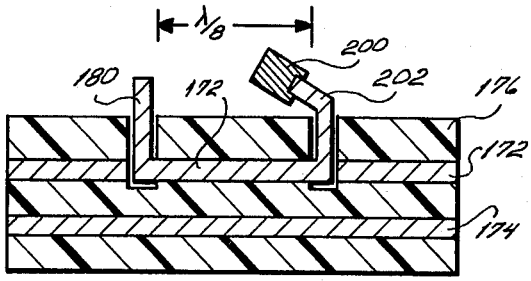
FIG. 22
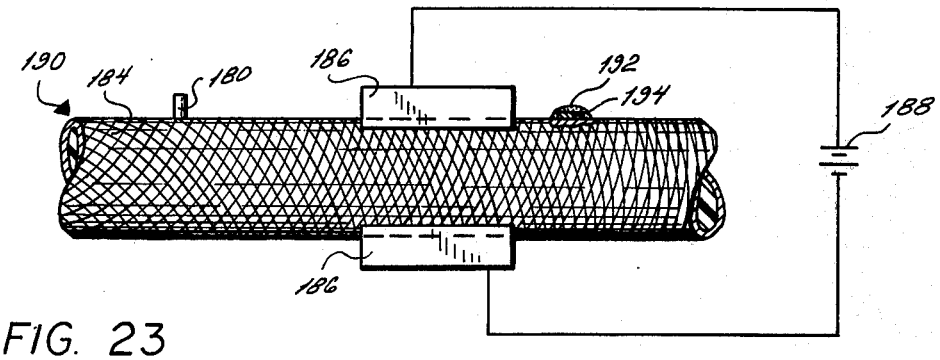
FIG. 23
FIG. 24a
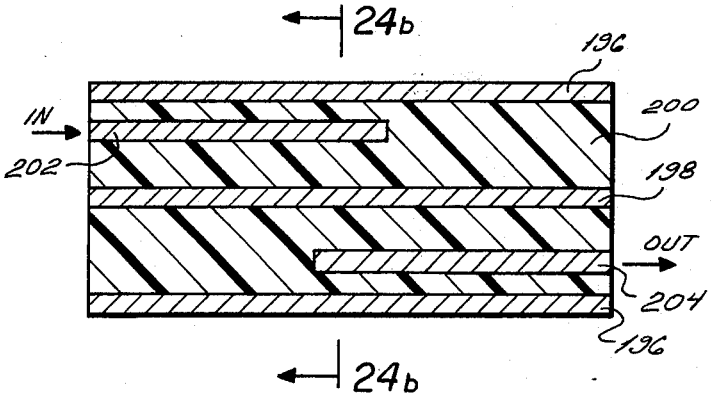
FIG. 24b
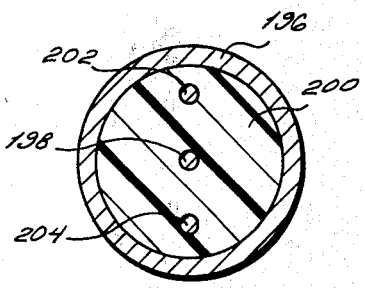

TRANSMISSION LINE FILTER

The aforementioned Abstract is neither intended to define the invention of the application which, of course, is measured by the Claims nor is it intended to be limiting as to the scope of the invention in any way.

BACKGROUND OF THE INVENTION

1. Field of the Invention

This invention relates in general to filter devices and more particularly to a transmission line filter which can be incorporated within a main line transmission system, and also describes a method for making a particular embodiment of the transmission line filter.

2. Description of the Prior Art

In various types of high frequency systems, such as microwave systems and television systems, it is necessary to incorporate a filter within the system. Numerous filter devices are presently available. However, most of these filters are complex and difficult to fabricate. Those filters which are produced in large quantities at inexpensive and reduced cost have restrictive limitations and usually do not provide narrow bandwidth or deep nulls. To achieve such narrow bandwidth and deep nulls requires more complex filtering devices. Additionally, the filters generally used in the art require separate coupling to the transmission system and cannot be directly interconnected in series with the transmission line.

One specific area which finds great use and need for a transmission line filter is in connection with cable television. In cable TV systems the programs are sent out along a main cable and various taps are positioned along the main cable which interconnect the various subscriber lines. It is necessary, however, to be able to control the programming to each subscriber so that only the subscriber paying for a particular program will receive it. Each subscriber generally has a discrete address on his line to direct the program along that subscriber line. However, various means are needed to insure that only a paid-for program will be sent along a particular subscriber line. Security systems are therefore needed within the cable TV system. Maximum security systems involve scrambling the video along with the audio as well as the color carrier. However, such security systems add cost to the TV programs. At the other extreme are some cable TV systems which do not have any security and only rely on automatic polling ater the program has been on for a considerable length of time. An in between compromise is to utilize filters at the tap points of the feeder line. The cost and complexity of the filters, as well as the ability to controllably switch such filters is therefore an important part of a successful cable TV system.

SUMMARY OF THE INVENTION

It is accordingly an object of the present invention to provide a transmission line filter which avoids the aforementioned problems of prior art devices.

A further object of the present invention is to provide a transmission line filter which has two main conductor lines and includes a third conductive line of a length related to the wavelength of the signal to be filtered, wherein the third conductive line is spaced apart from but electrically coupled to one of the main line conductors.

A further object of the present invention is to provide a coaxial filter which includes a conductive strip spaced apart from but electrically coupled to the inner conductor and having one end thereof conductively connected to the outer conductor.

Still a further object of the present invention is to provide a coaxial filter trap having sections of conductive line length $\lambda/8$ located within the dielectric material, separated from the inner conductor by a fixed distance.

Yet a further object of the present invention is to provide a coaxial filter having an additional electrical conductive line located within the dielectric of a length $\lambda/8$, having one end of the conductive line electrically connected to the outer shield, and the other end capacitively coupled to ground.

A further object of the present invention is to provide a coaxial filter trap wherein a third conductive line is positioned within the dielectric material and spaced apart a distance from the inner conductor, such that the distance between the inner conductor and the third conductive line controls the Q and bandwidth of the filter.

Still another object of the present invention is to provide a coaxial bandpass filter having additional conductive lines located within the dielectric, wherein the length of each conductive line is related to the wavelength of a signal forming the limits of the frequency band.

Yet a further object of the present invention is to provide a coaxial cable filter including a folded over section of transmission line on the outer shield which forms a shorted length of transmission line.

Still another object of the present invention is to provide a transmission line filter formed of triaxial cable having the two shields shorted together to simulate a folded over section of transmission line forming a shorted length of line onto the inner shield.

Yet another object of the present invention is to provide a transmission line filter utilizing quadraxial cable including an inner conductor and three shields, wherein the three shields are shorted together to provide a double folded section to thereby create two resonators on top of each other.

Another object of the present invention is to provide a transmission line filter including a controllable switch to permit opening and closing of the filter.

A further object of the present invention is to provide a transmission line filter including a controllable switch which can be arranged to permit failure of the filter in either the trapped or the pass mode.

Still a further object of the present invention is to provide a transmission line filter having a plurality of sections of resonators and including terminal connectors at either end of the filter to permit insertion of the filter directly in a main transmission line.

A further object of the present invention is to provide a transmission line filter for use in a cable TV system.

Yet another object of the present invention is to provide a switchable coaxial filter which can be inserted in a subscriber line of a cable TV system.

Another object of the present invention is to provide a method for making a coaxial filter.

A further object of the present invention is to provide a method for making a coaxial filter trap which includes the placing of an additional conductive line in the dielectric and utilizing the additional conductor line to form spaced apart resonators.

These and other objects, features and advantages of the invention will, in part, be pointed out with particularity and will, in part, become obvious from the following more detailed description of the invention taken in conjunction with the accompanying drawings which form an integral part thereof.

Briefly, the invention described a transmission line filter comprising a first conductor, a second conductor and a first insulation means separating the first and second conductors. A third conductor, of a length related to the wavelength of the signal being filtered, is located in the first insulation means in a spaced apart relationship with the first conductor but being electrically coupled thereto. Terminal connectors are placed at either end of the filter and serve as the filter input and filter output thereby permitting the filter to be included directly within a main transmission line. In one embodiment, one end of the third conductor is conductively conducted to the second conductor. The transmission line filter can be formed in a coaxial embodiment. The filter can either be a bandpass filter or a filter trap. By including a controllable switch in the transmission line filter, the filter finds particular application in a cable TV system wherein the switchable filter can be included in one of the subscriber lines.

A method is provided for making a coaxial filter, by first extruding a dielectric over two axially spaced apart longitudinal conductive lines. A small section of the dielectric is then chopped out at spaced intervals and one of the conductive lines is cut at each of the chopped out sections. The portion of the cut conductive line is then bent upward to protrude above the dielectric. The dielectric is covered with a conductive shield which permits the protruding portion of the conductive line to extend through the conductive shield. The protruding portion is then folded onto the conductive shield and electrically connected thereto. An insulating covering is then placed over the conductive shield.

In another embodiment of the invention, a multiaxial cable is provided with an inner conductor, and at least two outer conductive sheaths with insulating means separating each of the conductors. The outer sheaths are coupled together at two spaced apart locations to effectively form a folded over section of a shorted conductor onto one of the conductive sheaths.

BRIEF DESCRIPTION OF THE DRAWING

In the drawing;

FIG. 1 is a schematic drawing of a section of transmission line including a parallel resonant circuit in series with its center conductor;

FIG. 2 is a schematic drawing of a transmission line with a parallel resonant circuit in series with its outer conductor;

FIG. 3 is a schematic drawing of a transmission line having a series resonant circuit in shunt between its inner and outer conductors;

FIG. 4*a* is a schematic drawing of a parallel resonant circuit and FIG. 4*b* is the transmission line equivalent thereof;

FIG. 5*a* is a schematic drawing of a series resonant circuit and FIG. 5*b* is the transmission line equivalent thereof;

FIGS. 6*a* and 6*b* show a section of coaxial cable including a folded over resonator on the inner conductor;

FIGS. 7*a* and 7*b* show a section of coaxial cable including a folded over section on the outer conductor;

FIGS. 8*a* and 8*b* show a section of triaxial cable simulating a folded over section on the outer conductor;

FIGS. 9*a* and 9*b* show a section of quadraxial cable simulating a double folded over section on the outer conductor;

FIG. 10 is a schematic drawing of a filter including an electrically coupled parallel resonant circuit;

FIGS. 11 and 12 show a coaxial embodiment of a filter trap;

FIGS. 13 and 14 show a coaxial embodiment of a filter trap for filtering out two frequencies;

FIGS. 15*a* and 15*b* show multiple sections of a coaxial filter trap;

FIG. 16 shows a coaxial switchable filter which fails in the trapping mode;

FIG. 22 shows another embodiment of a coaxial filter trap;

FIG. 23 shows one step in the method of making a coaxial filter trap; and

FIGS. 24*a* and 24*b* show a coaxial bandpass filter.

DESCRIPTION OF THE PREFERRED EMBODIMENT

Figure 17:
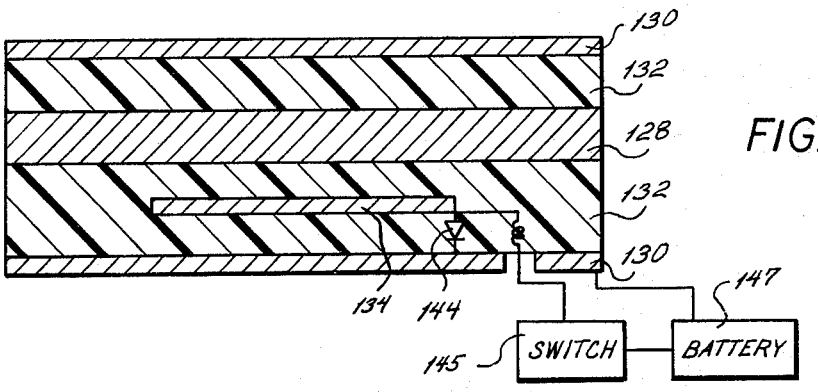
FIG. 17 shows a coaxial switchable filter which fails in the pass mode.

In a forming a filter, a resonant circuit is generally utilized, having a resonant frequency the same as the frequency of the signal which is to be filtered. In forming a transmission line filter, there are various ways of including this resonant circuit into the transmission line. Referring to FIG. 1, there is shown a transmission line generally at 10, which includes an inner conductor 12 and an outer conductive sheath 14. For purposes of simplification, the dielectric between the inner and outer conductors is not shown and similarly, the insulating coating usually surrounding the outer conductive sheath 14 is also not shown. However, for those skilled in the art, these items would normally be part of a coaxial cable.

As shown in FIG. 1, the resonant circuit, including the parallel combination of an inductor 16 and a capacitor 18, is placed in series with the inner conductor 12.

Another way of forming a transmissionline filter is as shown in FIG. 2, wherein the transmission line 10 now has the parallel resonant circuit, including the inductor 16 and the capacitor 18, placed in series with the outer conductive sheath 14. A third way of forming the filter is to utilize a series resonant circuit instead of the parallel resonant circuit. Such arrangement is shown in FIG. 3 wherein a series resonant circuit including the inductor 16 and the capacitor 18 is placed in shunt arrangement between the inner conductor 12 and the outer conductive sheath 14.

FIGS. 1–3, are shown as electrical schematic drawings including the inductor and capacitor as discrete elements. However, when forming an actual transmission line, instead of the discrete electrical components, transmission line equivalents are utilized. Referring now to FIGS. 4a and b, the equivalent of the parallel resonant circuit including the inductor 16 and the capacitor 18 is shown as a shorted length of transmission line 20 of a length $\lambda/4$ wherein $\lambda$ is the wavelength of the resonant frequency. Such equivalent is shown in 4*b* as a transmission line 20 including an inner conductor 22 shorted by means of a shorting line 24 to an outer conductive sheath 26. The transmission line equivalent of the series resonant circuit shown in FIG. 5*a* including the inductor 16 in series with capacitor 18, would be an open circuited length of transmission line of λ/4 length, as shown in FIG. 5*b*. In this case the inner conductor 22 and the outer conductive sheath 26 are not connected.

Utilizing the transmission line equivalents shown in FIGS. 4 and 5, one can now form a practicl embodiment of the schematic circuit shown in FIG. 1. Thus, a parallel resonant circuit in series with the inner conductor as shown in FIG. 1, would now appear as a shorted length of transmision line of λ/4 length in series with the inner conductor. This is shown in FIG. 6*a* and *b* wherein a section 28 of coaxial transmission line is shown and including an inner conductor 30, an outer sheath 32, and a dielectric 34 separating the inner and outer conductors. a folded over section of the inner conductor is shown generally at 36 which is of a length λ/4. The folded over section would provide a shorted length of transmission line in series with the inner conductor. However, to manufacture the embodiment shown in FIGS. 6*a* and *b* would be impractical and expensive.

In order to provide a practical transmission line equivalent of the circuit shown in FIG. 2, it would be necessary to include a shorted section of transmission line of length λ/4 in series with the outer conductor. This is shown in FIGS. 7a and *b* which show a section 38 of transmission line having an inner conductor 30 and outer conductor 32 with a dielectric medium 34 separating the conductors. A shorted length of transmission line of length λ/4 is included in series with the outer conductive sheath. This shorted length could be folded over onto the outer sheath itself to form the configuration shown at 42 in dotted lines. The folded over section 42 of the shorted transmission line lying over the outer conductive sheath can be achieved in a practical manner by utilizing cable as shown in FIGS. 8*a* and *b*. A section of such triaxial shown at 44, includes an inner conductor 46 separated from a first outer conductive sheath 48 by means of a dielectric 50. A second outer conductive sheath 52 is separated from the first sheath 48 by means of a second dielectric 54. The two dielectrics 50, 54 can yield a different characteristic impedance from each other. In order to form the folded back section, a first groove 56 is made in both of the outer sheaths 48, 52. A conductive member 58 is then interconnected between the first and second sheaths 48, 52 within the groove 56. At another location spaced from the first groove 56, a second groove 60 is made, this time only in the outer most conductive sheath 52. A second conductive member 62 connects the first and second conductive sheaths 48, 52 in the groove 60. In this manner, the section 64 forms a folded over shorted section of transmission line in series with the outer conductive sheath 48. The length of the folded over section 64 can be of length λ/4 where λ is the wavelength of the signal to be filtered. In this manner, a resonator of the desired frequency is connected in series with the outer sheath. It is noted that even though triaxial cable is utilized, the filter is effectively a coaxial cable, since the outer most conductive sheath 52 is only utilized to form the folded over section, but does not take part in the main line transmission system.

Multiple sections of the filter can be fabricated by utilizing the triaxial cable of FIGS. 8a, b and placing the resonators of λ/4 length at adjacent spacings axially along the filter. Terminal connectors can then be placed at the ends of a multiple section filter, and the filter could then be serially positioned within a main transmission line to provide a filter trap of the desired frequency.

An alternate way of providing a multiple section filter having folded over the sections of shorted transmission line is shown in FIGS. 9*a, b*. In these figures, quadraxial cable is utilized as shown generally at 66. The cable includes an inner conductor 68 separated from a first sheath 70 by a first dielectric 72; a second sheath 74 separated from the first sheath by a dielectric 76, and a third sheath 78 separated from the second sheath by a third dielectric 80. The three dielectrics 72, 76 and 80 can each be of a different characteristics impedance. The main line conductors for the transmission signal are the inner conductor 68 and the first sheath 70. The outer sheaths 74, 78 are only utilized for a double folded over section to achieve the equivalent of two resonators placed one on top of the other. In order to fabricate the double folded over sections, a first groove 82 is formed colinearally in all three outer sheaths 70, 74, 78. A conductive member 84 interconnects all three sheaths in the groove 82. At a distance spaced from the first groove 82, is a second groove 86 which is placed in the two outer most conductive sheaths 74, 78. A conductive member 88 interconnects the outer most sheath 78 with the inner most sheath, and a second conductive member 90 interconnects the sheath 70 with the next adjacent conductive sheath 74. In this manner a first folded over shorted transmission section is formed utilizing the conductive member 84, the outer conductive sheath 74 and the conductive member 90. At the same time a second shorted transmission line is achieved folded over the first shorted transmission line. The second folded transmission line section utilizes the conductive member 84, the outer most sheath 78 and the conductive member 88. In this manner, two resonators are located one on top of the other. The length of the resonators are each λ/4. Utilizing the arrangement shown in FIGS. 9*a, b*, the length for two sections of resonators is still λ/4 instead of a length of λ/2 which would be needed utilizing the triax cable shown in FIGS. 8*a, b*. Multiple sections of the filter shown in FIGS. 9*a, b* could be fabricated by spacing the double folded over sections apart from each other. A usable filter could be then formed by placing connectors at opposite ends of the multiple section filter and interconnecting the multiple section filter within a main transmission line. The outer most two layers 74, 78 are only utilized to permit easy fabrication of the double folded over section but do not actually participate in the transmission of the signal itself.

Either of the techniques shown in FIGS. 8*a*, 8*b*, or FIGS. 9*a*, 9*b*, provide for an inexpensive and easily fabricated coaxial filter trap. For certain applications, however, the embodiment shown has limitations. For example, the unloaded Q of the resonators must generally be quite high in order to produce deep nulls in a filter. For the highest unloaded Q, the optimum impedance of the resonators should be about 70 ohms. At the same time, in order to achieve a narrow bandwidth or a small percentage bandwidth, it is necessary that the parallel resonant circuit should be fabricated from very low impedance lines. For the series resonant circuits, high impedance lines would be utilized. Therefore, in the embodiments heretofore shown utilizing a parallel resonant circuit, low impedance lines should be used to produce a narrow bandwidth. However, the unloaded Q will therefore not be high enough to provide deep nulls. While low impedance lines of approximately 7 ohms would be adequate for trapping out channels which are not closely spaced to adjacent channels, in order to trap out a channel with closely spaced adjacent channels it would be necessary to use impedance lines lower than even 7 ohms to obtain such a narrow bandwidth. However, this would produce a Q which would be too low for adequate rejection of a channel without effecting an adjacent channel.

In order to obtain these apparent conflicting requirements, it is possible to utilize a resonator having an impedance of 70 ohms so as to obtain a high Q and, nevertheless maintain a narrow bandwidth. This is achieved by not directly interconnecting the resonant circuit to the main conductive lines but instead separating it from the conductive lines electrically coupling it to the lines. In this manner, it is possible to both optimize the loss and control the bandwidth by varying the spacing between the resonant circuit and the conductive line to thereby control the coupling coefficient.

Referring now to FIGS. 10 there is shown a schematic diagram showing a transmission line generally at 92 having an input terminal 94 and an output terminal 96 with a first conductive line 98 and a second conductive line 100. The parallel resonant circuit 102 is shown spaced from the conductive line 98 but electrically coupled thereto. One end of the resonant circuit 102 is, however, electrically connected to the other conductive line 100 by means of the conductor 104.

Referring now to FIGS. 11 and 12 there are shown the coaxial line equivalent of the transmission line filter shown generally in FIG. 10. In FIGS. 11 and 12 the coaxial line is shown at 126 and includes a center conductor 128 separated from an outer conductive sheath 130 by means of a dielectric medium 132. Another conductive line 134 is located within the dielectric medium 132 spaced from the inner conductor 128 by a distance d. The conductive line 134 is parallel to the inner conductor such that the distance d is uniform throughout the length of the conductive 134. The distance d can be preset to thereby control the coupling coefficient for determining the bandwidth of the filter. The conductive line 134 is electrically connected to the outer sheath 130 by means of the conductive member 136. The length of the conductive member 134 is $\lambda/4$ wherein $\lambda$ is the wavelength of the signal to be filtered.

Referring now to FIGS. 13 and 14, there is shown how the same inventive approach can be utilized to filter out more than one frequency. Thus, in addition to the conductive line 134 of a length $\lambda/4$ which filters out frequencies having a wavelength $\lambda$, a second conduuctive line 140 can be included of a length $\lambda/4$ which would filter out frequencies having a wavelength $\lambda_2^4$. The conductive line 140 is also spaced from the inner conductor 128 and is electrically coupled thereto. It is also conductively connected to the outer conductive sheath 130 by means of the conductive member 142.

Multiple sections of the filter can be formed as shown in FIGS. 15*a* and *b* which shows multiple sections of the coaxial filter of the type shown in FIGS. 11 and 12, wherein each of the conductive line sections 134 are of a length$\lambda/4$ and are slightly spaced apart from each other. The multiple section filter is shown to include terminal connectors at either end thereof to permit the insertion of the coaxial filter directly in series with a transmission line.

A bandpass coaxial filter could also be formed, as shown in FIGS. 24*a* and *b* wherein the coaxial line includes an outer conductive sheath 196 separated from an inner conductor 198 by the dielectric 200. Two additional conductive lines 202, 204 are also located in the dielectric, each spaced from the inner and outer conductors. Each of the additional conductive lines 202, 204 are of a length $\lambda/4$ wherein $\lambda$ is the wavelength at the center frequency and the coupling coefficient determines the bandwidth and variation in bandpass insertion loss. Conductive line 202 serves as the filter input and conductive line 204 serves as the filter output.

It is also possible to make the filter heretofore described as a switchable filter by including a controllable switch in the filter section. One such well known type of controllable switch is a diode; however, relays or other well known switches could also be utilized. The switch is included to open and close the shorted end or open end of the resonator, depending upon whether a series or parallel resonator is utilized. Also, whether the switch opens or closes the end will depend upon which mode the filter fails in, i.e., the trapped mode or the pass mode (Assuming excess current will have the diode fail as an open circuit).

Referring now to FIG. 16 there is shown an embodiment of the switchable filter of the type heretofore described wherein the filter fails in the trapped mode. The coaxial filter includes an inner conductor 128 separated from the outer conductor 130 by means of the dielectric 132 and including the conductive line 134 electrically coupled to the inner conductor 128 and conductively connected to the outer sheath by means of conductive member 136 at one end thereof. The controllable diode switch 144 interconnects the other end of the conductive line 134 to a battery source 147 through a controllable switch circuit 145. When the diode 144 is conducting, the conductive line 134 will not have any effect on the coaxial line section and will not filter out any signal. On the other hand, when the diode 144 is nonconducting, the conductive line 134 will serve to trap out the signal being filtered. In this manner, should the diode 144 fail to operate, the filter shown in FIG. 16 will remain in the trapped mode and will filter out the frequency of the signal.

Referring now to FIG. 17 there is shown another method of utilizing the diode switch to form a switchable filter. In this embodiment, the diode switch 144 forms part of the conductive interconnection between the conductive line 134 and the outer conductor sheath 130. The diode is controlled by a circuit connecting the diode to a switch 145 and to a battery 147. When the diode 144 is conducting the conductive line 134 is operative to trap out the signal being filtered. On the other hand, when the diode switch 144 is nonconducting, the line 134 will not operate to filter out the frequency. Therefore, if the diode 144 fails the coaxial section shown in FIG. 17 will remain in the pass mode and will not filter out any signals.

Figure 18:
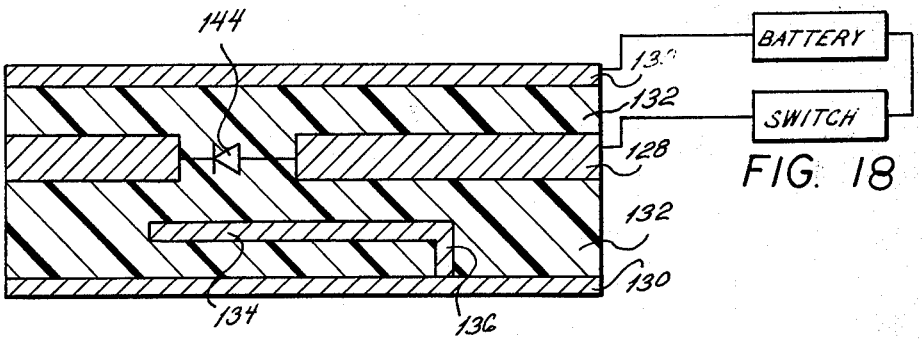
FIG. 18 shows a switchable coaxial filter which can disconnect the entire flow of the signal.

It is also possible to include the diode 144 directly in series with the inner conductor 128 as shown in FIG. 18. In this way when the diode is not conducting, no signal at all will pass through the entire filter section.

Figure 19:
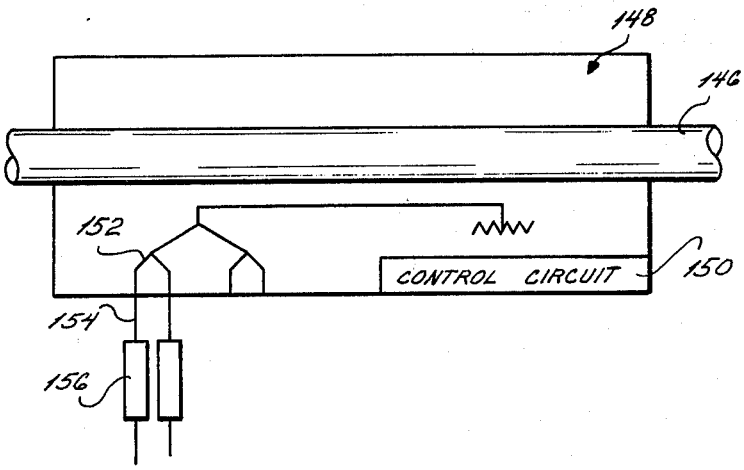
FIG. 19 is a schematic drawing of a switchable filter used in a cable TV system.

The switchable filter heretofore described in FIGS. 16–18 finds particular use in connection with cable television systems. In such systems it is necessary to have control over the program being sent to a subscriber. When the subscriber has paid for the program, the program will be sent to the subscriber line. However, if not paid for, it is necessary to restrict the program signal from being sent to the subscriber line. A switchable filter is of convenient use for such purposes. Referring now to FIG. 19 there is shown how such a switchable filter of the type heretofore described could find use in a cable television system. The main line of the cable television system is shown at 146. A directional tap is shown generally at 148 and includes control circuitry 150 for controlling the address location of each of a plurality of taps 152. Each of the taps controls a different subscriber line 154. The switchable trap 156 is interconnected in the subscriber line. The switchable trap can be utilized to connect or disconnect a particular program from the subscriber line. Utilizing the control address circuitry 150, it is possible to control the switchable trap directly from the main office utilizing the control address of the particular subscriber line.

Using the filter trap as shown in FIG. 16, the filter would fail in the trapped mode while utilizing the switchable filter in FIG. 17 it would fail in the pass mode. Probably the embodiment shown in FIG. 16 would be more advantageous since in this way the subscriber would notify you if the switchable filter failed. Also, in the embodiment of FIG. 16 the diode has less effect on the Q of the resonator. On the other hand, utilizing the embodiment in FIG. 17 should a failure occur in the switch the program would still come to the subscriber and chances are the subscriber would not notify the station if a failure occurred in the pass mode. If the embodiment of FIG. 18 were used, there would be an additional control in that the entire service would be disconnected from the subscriber line. The embodiment shown in FIG. 18 could of course be utilized in conjuction with the switching control of the filter thereby obtaining the dual control of both a switchable trap as well as complete disconnecting of service.

Figure 20:
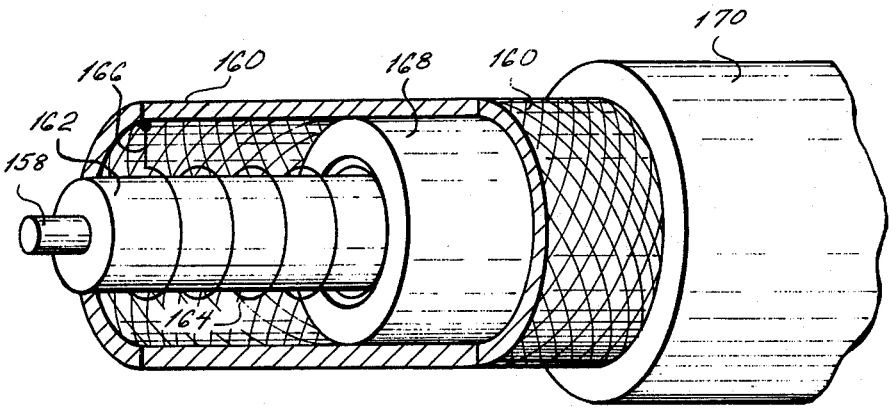
FIG. 20 shows another embodiment of a coaxial filter trap.
Figure 21A:
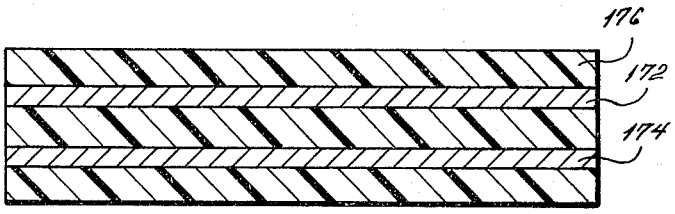
FIGS. 21*a*–21*e* show various steps in a method for making a coaxial filter trap.
Figure 21B:
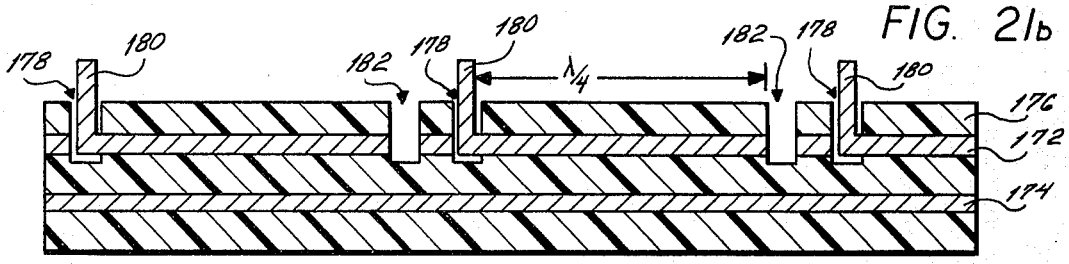
Figure 21C:
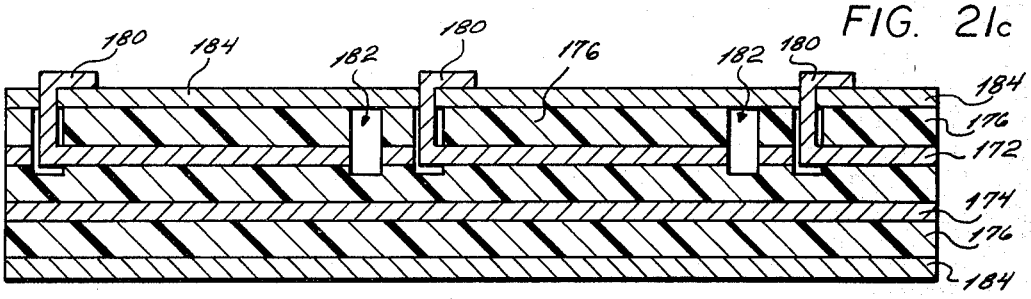
Figure 21D:
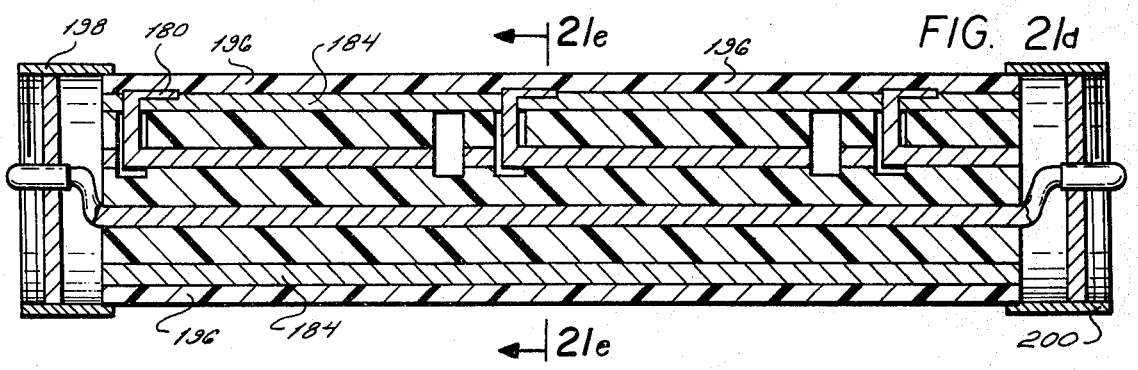
Figure 21E:
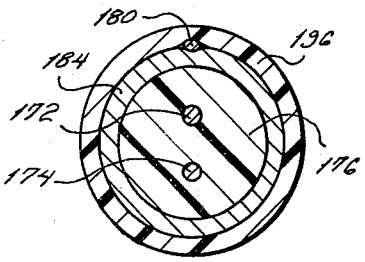

Referring now to FIG. 20 there is shown an additional embodiment of the coaxial filter heretofore described. In FIG. 20, the coaxial cable includes an inner conductor 158, an outer conductive sheath 160, a first dielectric 162 located around the inner conductor and a spiral conductive winding 164 wound around the dielectric 162. In this manner the conductive winding 164 will be positioned at a fixed distance from the inner conductor 158 and will be electrically coupled thereto. One end 166 of the spiral conductor is conductively connected to the outer conductive sheath 160 by line 166. A second dielectric 168 separates the spiral winding 164 from the outer sheath 160. The length of the spiral conductor would be less than $\lambda/4$ because of mutual coupling between turns. The outer conductive sheath 160 is shown as a braided conductor. A plastic outer coating 170 is shown over the conductive braid 160.

The embodiment shown in FIG. 20 can be made by continuously forming the various layers and then notching out and isolating the $\lambda/4$ spiral sections. After that the spiral sections could be conductively connected to the outer conductor sheath. This method will become better understood hereinafter, in connection with the method for making the coaxial filter embodiment.

Referring now to FIGS. 21*a—e* there is shown a method of making a coaxial filter of the type heretofore described in connection with FIG. 15. Initially, two inner conductors 172, 174 are spaced apart, and a dielectric 176 is extruded over the accurately spaced apart conductors. Using a tool and die, sections 178 are chopped out of the dielectric 176. At the same time, the conductor 172 is cut and a portion of 180 is bent upwardly to protrude above the dielectric 176. Additional notches 182 are also chopped out of the dielectric 176 as well as from the conductor 172. The spacing between the protruding section 180 and the chopped out section 182 is approximately $\lambda/4$.

The dielectric covered conductors are now sent to a braiding machine which adds the outer conductive sheath 184, typically a braided conductor. When the braiding is put on, the portions 180 which protrude above the dielectric also extend through the braiding. The protruding portions 180 are then bent over the conductive sheath 184 so as to be substantially flush with the braid, and are then electrically connected to the conductive braiding by either soldering, welding or the like.

If the protruding sections 180 are welded onto the braided conductive sheath 184, it is possible to both bend and weld the member 180 during the same processing step. This can be seen by referring to FIG. 23, wherein electrodes 186 are shown connected to an energy source 188. The braided cable, shown generally at 190, passes through the electrodes whereby the electrodes will both bend the protruding section 180 and at the same time weld them onto the conductive braided sheath 184. The finished product is shown at 192 which shows the weld located above the bent member 194.

Referring back to FIG. 21d it is noted that after the protruding sections have been bent and welded onto the conductive sheath 184, the cable is now passed through an extruder which places a plastic jacket 196 over the entire cable. One or more sections may now be cut off and terminal connectors 198, 200 can then be placed on either end of the coaxial filter, such that one of the connectors serves as the input and the other serves as the output.

Although the device shown in FIGS. 21*a*–21*e* is for a filter trap, it is understood that the bandpass filter could also be made in a similar manner.

Referring now to FIG. 22 there is shown another embodiment whereby the length of the conductive line can be reduced. In addition to having the one end 180 protruding from the dielectric 176, the other end 202 is also made to protrude above the dielectric. While the end 180 will then be conductively connected to the outer electrical braided sheath, the end 202 will be terminated in a capacitor 200 which will be connected to ground. This will reduce the length of the filter to less than $\lambda/4$, the length depending on the value of C, and increase the frequency at which the trapping effect repeats itself. This also avoids the well known three times the frequency experienced with ¼ wavelength sections.

There has been disclosed heretofore the best embodiment of the invention presently contemplated. However, it is to be understood that various features and modifications may be made thereto without departing from the spirit of the invention.

What I claim as new and desire to secure by Letters Patent is:

1. A coaxial filter having two ends for insertion between transmission lines comprising an inner conductor, at least one conductive outer sheath, first insulation means separating said inner conductor from said outer conductive sheath, a section of conductive line extending longitudinally within said first insulation means laterally spaced apart from said inner conductor and electrically coupled thereto, second insulating means covering said outer sheath and coaxial terminal connectors at the opposite ends of said coaxial filter to permit said coaxial filter to be interconnected between the transmission lines, one of said terminal connectors serving as the filter output and wherein the length of the section of conductive line is approximately $\lambda/4$, wherein $\lambda$ is the wavelength of the signal to be filtered by the coaxial filter.

2. The filter as in claim 1 and further comprising connection means for conductively interconnecting one end of said section of conductive line with said outer conductive sheath.

3. The filter as in claim 2 and wherein said section of conductive line is parallel to said inner conductor and laterally spaced apart a distance *d* therefrom throughout its length, wherein *d* is dependent upon the electrical coupling desired between the inner conductor and the section of conductive line.

4. The filter as in claim 2 and further comprising a second section of conductive line longitudinally extending within said first insultation means laterally spaced apart from said inner conductor and electrically coupled thereto, second connection means for conductively interconnecting one end of said second section of conductive line with said outer conductive sheath, said second section of conductive line being of a length $\lambda/4$ wherein $\lambda'$ is the wavelength of the frequency of a second signal passing through the coaxial filter, whereby said filter is capable of filtering out signals of two different frequencies, and wherein the lengths of said first and second sections of conductive lines longitudinally overlap.

5. The filter as in claim 2 and further comprising a plurality of said sections of conductive line, all said sections of conductive line being colinear with each other along a common line and axially spaced apart from each other along said common line.

6. The filter as in claim 2 and wherein said section of conductive line is spirally wound around the inner conductor, said first insulation means being located between said spirally wound conductive line and said inner conductor, and further including second insulation means separating said spirally wound conductive line and said outer conductive sheath.

7. The filter as in claim 2 and further comprising a controllable switch electrically connected to said section of conductive line, and a control circuit coupled to control said switch for selectively introducing and removing the filter from the transmission line.

8. The filter as in claim 2 and further comprising a controllable switch electrically connected in series with said inner conductor.

9. The filter as in claim 7 and wherein said controllable switch is coupled between the other end of said conductive line and said control circuit, and wherein said control circuit further comprises a switch means in series with energy source means.

10. The filter as in claim 7 and wherein said controllable switch is coupled in said connecting means and thereby positioned between said one end of conductive line and said outer conductive sheath.

11. The filter as in claim 7 and wherein said controllable switch is a diode.

12. The filter as in claim 1 and further comprising a second section of conductive line lingitudinally positioned in said first insulation means laterally spaced from said inner conductor and electrically coupled thereto, said second section of conductive line being axially displaced from said first section of conductive line, one of said sections of conductive line being adapted to receive the signal to be filtered and the other section of said conductive line producing the filter output, the length of each section of conductive line being $\lambda/4$ wherein $\lambda$ is the wavelength at the center frequency and the coupling coefficient determines the bandwidth and variation in bandpass insertion loss.

13. A multiaxial filter comprising an inner conductor, at least two outer conductive sheaths, first insulation means separating said inner conductor from said first outer conductive sheath, second insulation means separating said first outer conductive sheath from said second outer conductive sheath, both said outer sheaths having a colinear circumferential groove therein, said second sheath having a second circumferential groove therein spaced axially from said first groove, first interconnection means electrically connecting said first and second conductive sheaths within said first groove, and second interconnecting means electrically connecting said first and second outer conductive sheaths in said second groove, thereby effectively forming a folded over short circuit transmission line section onto said first conductive sheath.

14. The filter as in claim 13 and wherein the axial distance between said first and second interconnecting means is $\lambda/4$ wherein $\lambda$ is the wavelength of the signal to be filtered, and wherein a plurality of said folded over sections are axially spaced from each other.

15. The filter as in claim 13 and further comprising a third conductive sheath, a third insulating means separating said second and third conductive sheaths, said third conductive sheath having a first circumferential groove therein colinear with said aforementioned first circumferential groove, and a third circumferential groove substantially colinear with said second circumferential groove, said first interconnecting means also electrically connecting said first conductive sheath with said third conductive sheath in said first circumferential groove, and further comprising third interconnecting means electrically connecting said first and third conductive sheath in said third circumferential groove, thereby effectively forming a double folded over section onto said first conductive sheath.

16. The filter as in claim 15 and wherein the axial distance between said first and second, as well as said first and third interconnecting means are substantially $\lambda/4$ wherein $\lambda$ is the wavelength of the signal to be filtered, and wherein a plurality of said folded over sections ar axially spaced from each other.

17. In a cable TV system, including a main cable line, a directional tap coupled to said main cable line and plurality of subscriber lines respectively coupled to said directional tap comprising:

a switchable trap serially connected in at least one of said subscriber lines, said switchable trap comprising a coaxial filter including an inner conductor, at least one outer conductive sheath, first insulation means separating said inner conductor from said outer conductive sheath, a section of conductive line extending longitudinally within said first insulation means laterally spaced apart from said inner conductor and electrically coupled thereto, second insulating means covering said outer conductive sheath means for conductively interconnecting one end of said section of conductive line to said outer sheath, and a controllable switch electrically connected within said switchable trap to selectively apply and remove the filtering on said subscriber line to thereby open and close said subscriber line.

18. The system as in claim 17 and wherein said controllable switch is connected to one end of said section of conductive line and is coupled to a control circuit, said control circuit including a switch means in series with an energy supply means.

19. The system as in claim 18 and wherein said controllable switch is a diode.

20. The system as in claim 17 and wherein said directional tap includes a control circuit for individually addressing each of the subscriber lines, said control circuit also controlling the switchable trap in the line.

21. A method of making a coaxial filter comprising the steps of:

a. extruding a dielectric over two accurately spaced apart longitudinal conductive lines;
b. chopping out small sections of the dielectric at spaced intervals;
c. cutting one conductive line at each chopped out section;
d. upwardly bending a portion of said one conductive line at each chopped out section to protrude above the dielectric
e. covering the dielectric with a conductive shield permitting said portions to protrude through said conductive shield;
f. folding the protruding portions of the conductive line onto the conductive shield;
g. electrically connecting the folded over portion onto the conductive shield; and
h. placing an insulating covering over the conductive shield.

22. The method as in claim 21 and further comprising the step of chopping out additional sections of the dielectric together with said one conductive line, such that the spacing of the one conductive line between said additional chopped out sections and said bent up portions are related to the wavelength of the signal being filtered.

23. The method as in claim 22 and wherein said related spacing as $\lambda/4$ wherein $\lambda$ is the wavelength of the signal being filtered.

24. The method as in claim 21 and wherein said step of folding, as well as said step of electrically connecting, are both achieved by the step of passing the covered dielectric material through electrodes which bend and weld the protruding portions onto the conductive shield.

25. The method as in claim 22 and further comprising the step of cutting off a unit length of the product produced after step (h), said unit length including at least one of said spacings of said one conductive line, and placing electrical conductors at the ends of said cut off unit.

* * * * *

UNITED STATES PATENT OFFICE
CERTIFICATE OF CORRECTION

PATENT NO. : 4,004,257

DATED : January 18, 1977

INVENTOR(S) : ROBERT G. GEISSLER

It is certified that error appears in the above-identified patent and that said Letters Patent are hereby corrected as shown below:

Claim 4, line 8, change "λ/4" to --λ'/4--.

Claim 12, line 2, change "lingitudinally" to --longitudinally--.

Claim 16, line 6, after "ar" insert --e--.

Claim 17, line 2, after "and" insert-- a--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*